United States Patent [19]

Gentreau

[11] 3,934,761

[45] Jan. 27, 1976

[54] OUTER CONTAINER ASSEMBLY FOR HOUSING AN AEROSOL

[75] Inventor: Guy Rene Gentreau, Vincennes, France

[73] Assignee: Les Parfums de Dana, Inc., New York, N.Y.

[22] Filed: July 25, 1974

[21] Appl. No.: 491,655

[30] Foreign Application Priority Data

Oct. 19, 1973 France ..... 73.37319

[52] U.S. Cl. ..... 222/183; 222/402.13

[51] Int. Cl.[2] ..... B65D 83/14

[58] Field of Search.. 222/182, 183, 402.12, 402.13; 239/499

[56] References Cited

UNITED STATES PATENTS

| | | | |
|---|---|---|---|
| 2,884,160 | 4/1959 | Abplanalp | 222/182 X |
| 2,966,283 | 12/1960 | Darvie | 222/183 |
| 3,101,160 | 8/1963 | Picot | 222/183 |
| 3,157,317 | 11/1964 | Ramsbotham | 222/183 |
| 3,347,423 | 10/1967 | Rahn et al. | 222/183 |
| 3,401,843 | 9/1968 | Ahrens et al. | 222/182 |
| 3,415,426 | 12/1968 | Kleveland | 222/402.12 X |
| 3,628,702 | 12/1971 | Kimura | 222/402.13 |

FOREIGN PATENTS OR APPLICATIONS

| | | | |
|---|---|---|---|
| 1,000,042 | 8/1965 | United Kingdom | 222/182 |

*Primary Examiner*—Stanley H. Tollberg
*Assistant Examiner*—Charles A. Marmor
*Attorney, Agent, or Firm*—Burgess Ryan and Wayne

[57] ABSTRACT

A container for a spray aerosol is provided in which the aerosol bottle is placed. The container has a movable top closure for operating the atomizer of the bottle. The top closure is provided with directing vanes adjacent the atomizer to direct spray to an orifice located in the outer surface of the container.

9 Claims, 4 Drawing Figures

OUTER CONTAINER ASSEMBLY FOR HOUSING AN AEROSOL

This invention relates to a container for a spray aerosol and has for its primary object the provision of a container of attractive design into which and from which a spray aerosol bottle may be quickly and easily placed and removed.

The present invention also relates to a novel packaging serving to deliver a product in the liquid state in the form of fine droplets projected in suspension in a vehicle gas. Liquid dispersions in a gaseous medium of this type are commonly used, in particular, to scent ambient air and to dispense cosmetic or personal hygiene products. These products are usually packed in receptacles with reinforced metal walls, opening to the outside through a valve kept closed by a spring or by the pressure of the vehicle gas contained in the receptacle or bomb. Pressure exerted on the head of the valve allows some of the gas contained in the bomb under pressure to escape, entraining with it a mist of fine products of active substance. Dispersions of this sort are used in body hygiene, cosmetic, medicinal and other similar preparations and such products are referred to as aerosols or sprays.

Products packed under pressure in containers with spray valves had a great many different applications and have had wide public acceptance for some time. Bomb or containers projecting a jet of product in fine droplets are relatively easy and effortless to operate; they work quickly, the jet action of the spray valve is easy to control, and the products are released in a dispersion of fine droplets thereby ensuring uniform and effective distribution of active substances.

However, bombs of this type are generally unattractive in appearance and ill fitted for prestige products such as perfume. These bombs are usually containers of cylindrical shape having a valve head consisting of a pushbutton. Attempts have been made to adorn these containers by adding a cap to cover the head and conceal the valve when not in use. Alternatively, the valve has often been covered with operating means actuated for example by a linkage for transmitting the gas thrust to the valve. These solutions have not been very reliable in their operation and they are generally costly to manufacture since the unit is to be discarded after use. As a result, the cost tends to become prohibitive for a disposable container.

It is likewise desirable to eliminate the risk of accidental opening of the valve in response to unintentional and inadvertent pressure. For example, if a foreign body should come to rest against the head of the valve in most conventional units, the valve can open and allow the vehicle gas and active products to escape, much to the dismay and annoyance of the consumer.

The object of the present invention is to remedy the various shortcomings of the prior art containers and provide a container for packing a liquid product dispersed in aerosol form in which the container is of novel and pleasing appearance while best providing for the aerosol dispensing function while at the same time avoiding the risk of accidental opening by pressure unintentionally exerted on the valve or spray head.

In accordance with the present invention, there is provided a container for housing a spray aerosol bottle having a tubular body with a spray orifice adjacent one end thereof. The bottle is mounted in the container and the spray section or atomizer of the bottle is placed adjacent one end. A movable top closure is positioned in the tubular body above the bottle spray section, and, when depressed, said closure activates the spray section. The normal return force of the spray section after it has been depressed returns the top closure to its rest position against the end of the body. The container of the instant invention provides a functional but attractive, streamlined and esthetic package which is easy to assemble and to manufacture.

For best results, the top closure is provided with a pair of vanes depending therefrom which extend from the top closure into the body. The vanes or fins are spaced apart and are adjacent the spray section of the bottle to define a spray path between the spray section and the container orifice. For best results, means are provided in the body and on the top closure for assuring that the spaced apart vanes are properly located adjacent the orifice.

Further, in accordance with the present invention, there is provided a container for housing a spray aerosol bottle which comprises an open ended tubular body formed with a spray outlet or orifice adjacent to the upper end thereof, a top closure capable of being introduced into the container through the open lower end thereof, and guided and slid through the body part, an abutment within the container adjacent the upper end thereof for preventing displacement of the top closure from the container through the upper end of the container, a pair of spaced apart vanes or fins depending from the underside of said top closure and defining a space that registers with said spray outlet and acts to guide spray discharged from an aerosol bottle housed in the container through the outlet, the discharge of said spray being effected by slight displacement of the top closure by pressing thereon to urge said closure against the spray release button of the spray section of the aerosol bottle. The top closure is suitably held flush with the upper surface of the container by the abutments. As such, the top closure does not project beyond the confines of the container and any accidental pressure exerted on the top of the container will be received by the upper edges of the container itself. As a result, external forces generally will not tend to act on the top closure itself and will help to prevent accidental triggering and opening of the spray head.

It will be understood that the dimensions of the casing are preferably chosen to fit the size and shape of the bottle selected so that the bottom of the top closure will reach the spray head, the top closure in this position not exerting any pressure on the spray head in its state of rest. Pressure is applied solely by the user's deliberately pressing the top closure. Generally, inexpensive glass or metal receptacles of standard manufacture may be used for the container.

It can be readily appreciated that the container made in accordance with the instant invention is esthetic in design and tends to eliminate the need for accessories such as protective caps which, of course, facilitate operation and use of the container by the ultimate consumer.

To enable the invention to be clearly understood, a preferred embodiment thereof will now be described, by way of example, with reference to the accompanying drawings wherein:-

Figure 1:
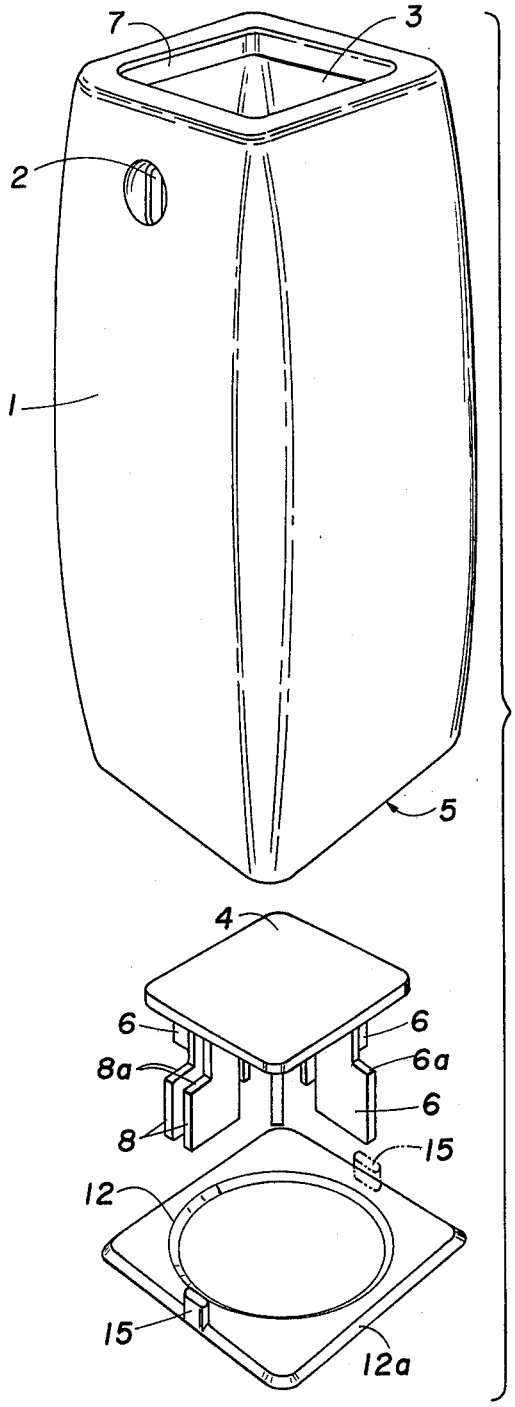
FIG. 1 is an exploded perspective view showing the three main parts of the container separated prior to assembly.

Referring to said drawings, the container comprises an open-ended tubular body part 1 formed with a spray outlet 2 adjacent to the upper and thereof. The upper open end 3 of the container is closed by a top closure member 4 of substantially flat plate-like form which can be inserted into the container through the lower open end 5 thereof and slid along the inside of the container to the upper end thereof.

This top closure 4 is formed with three or any other suitable number of depending fins or vanes 6 each formed with a stepped portion 6*a*. These portions 6*a* abut against the lower edge of a depending flange 7 extending around the mouth of the container at the upper end thereof and so prevents displacement of this top closure through the upper end of the body part 1.

Figure 2:
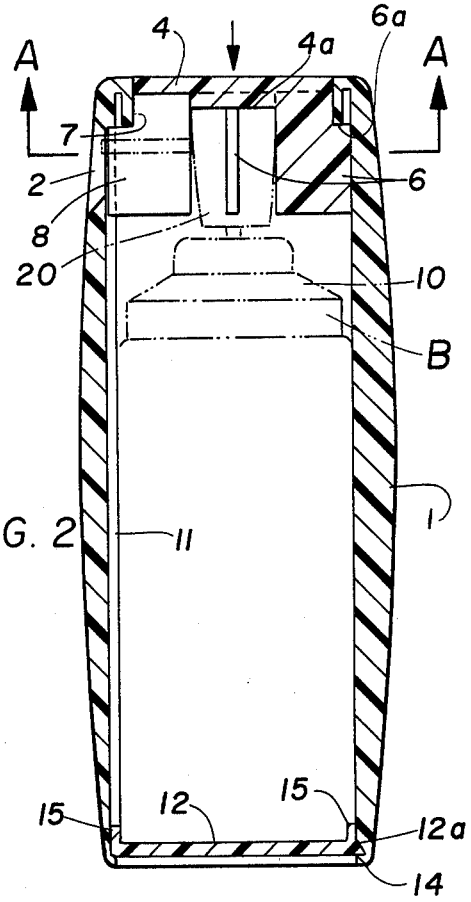
FIG. 2 is a vertical section showing an aerosol bottle in dotted outline inserted in the container.
Figure 3:
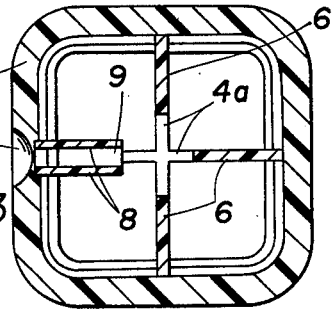
FIG. 3 is an inverted cross section taken on the line A—A of FIG. 2.
Figure 4:
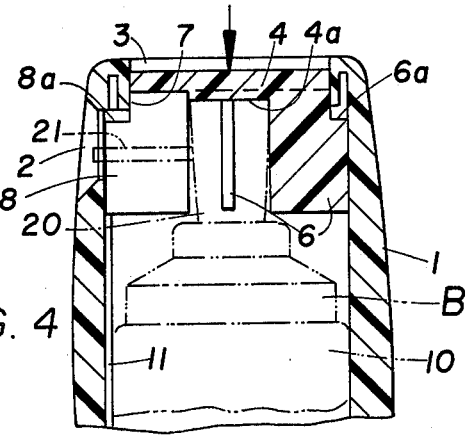
FIG. 4 is a vertical section through the upper part of the container showing the manner of operation.

The top closure 4 is also formed with a pair of slightly spaced apart vanes or fins 8 (see particularly FIG. 3) that define between themselves a space 9 that registers with the spray outlet 2 and acts to guide spray discharged from the depressable spray section of an aerosol bottle B indicated in dotted outline in FIG. 2. A spray tube 21 fitting between the spaced apart fins 8 and resting flush against spray opening 2 can be used to aid in directing the spray to the orifice 2 as shown in FIG. 4.

When the upper closure 4 is engaged in the body part 1 and slid therethrough to the upper end of the container, the fins 8, which are preferably made slightly wider than the vanes 6, engage in a longitudinal groove 11 formed in the wall of the container provided with the spray opening 2. This arrangement ensures that the top closure must come to rest with the pair of vanes 8 accurately positioned with respect to the outlet 2. The vanes are formed with stepped portions 8*a* similar to the portions 6*a* of the vanes 6 that abut the underside of the depending flange 7 at the mouth of the container.

The provision of the groove 11 also prevents turning of the top closure 4 about the longitudinal axis of the body part 1.

After the top closure 4 has been inserted into the body part 1 and an aerosol bottle B fitted therein, a bottom closure plate 12 is fitted into the lower open end of the container. The bottom closure plate 12 is formed with chamferred edges 12*a* that snap into undercut recesses 13 formed by ribs 14 extending partially along the lower edge of each wall of the container. This bottom closure plate 12 is formed with one or more upstanding keys 15 (not shown), one of which engages the lower open end of the groove 11. The recesses permit bottom closure plate 12 to be removed whenever it is desired to insert a fresh bottle into the container. Therefore a container made in accordance with the instant invention is reuseable although if desired, the bottom closure plate 12 can be permanently affixed to the tubular body.

It will be appreciated that when a slight pressure is imparted to the top closure plate 4, it results in slight downward movement of plate 4, with the result that the spray release button or the equivalent of the aerosol bottle is actuated and spray released from the aerosol passes into the space 9 between the vanes 8 and out through the spray outlet 2.

The downwardly directed face of the top closure plate is preferably formed with a pair of shallow intersecting ribs 4*a* that co-act with and press against the release button or the equivalent of the aerosol bottle when the plate 4 is depressed. This plate 4 is returned upwardly by the button reasserting itself when said plate is released so as to assume a position ready for a subsequent operation.

The three parts of the container, i.e., the body part 1, the top closure plate 4 and the bottom closure plate 12 are preferably made of a suitable synthetic plastic material which can be decoratively colored so as to be of pleasing appearance.

The embodiment described and illustrated is given by way of example only and modifications thereof are possible within the scope of the invention. For example, any other number and disposition of vanes or fins 6 and 8 may be provided.

What is claimed is:

1. An outer container assembly for housing a spray container of the type having a depressable spray valve member at one end thereof and a laterally extending spray nozzle at said one end, said outer container assembly comprising a tubular body having internal dimensions of a size to receive a spray container to be housed therein, said tubular body having an open bottom of a size to permit the spray container to be passed therethrough, and an inwardly extending flange at its top end defining a top opening, an upper closure member within said tubular body, said upper closure member having a plurality of vanes extending to slidably engage the inner surface of said body to hold said upper closure member in said tubular body, said closure member having peripheral dimensions enabling its assembly in said body by way of said open bottom while inhibiting passage through said top opening, said body being free of internal portions which would inhibit passage of said upper closure member from said open bottom to said top opening, said vanes further defining a space for receiving the spray valve member of a spray container assembled within said tubular body, a spray outlet in said tubular body, said upper closure member further comprising means for holding the spray nozzle of a spray container assembled therein aligned with said outlet, and a bottom closure member for closing said open bottom for holding a spray container within said tubular body, said closure member having a plate-shaped member extending into said top opening, said vanes depending from said plate-shaped member and having stepped portions positioned to engage said flange to inhibit passing of said upper closure member through said top opening, the upper surface of said plate-shaped member being substantially flush with the outer surface of said tubular body at said flange.

2. The assembly of claim 1, wherein said tubular body has a groove extending longitudinally in its inner surface from said open bottom substantially to said flange, and said vanes include at least two spaced-apart vanes slidably engaging said groove to inhibit rotation of said upper closure member with respect to said tubular body.

3. The assembly of claim 2, wherein said vanes extend inwardly with respect to said tubular body to engage said depressable valve member, said two spaced-apart vanes engaging said groove being positioned to hold said spray nozzle therebetween and direct said spray nozzle toward said outlet.

4. In a spray assembly of the type having a spray container, a spray valve and nozzle means for dispensing liquids from said spray container, an outer tubular body within which the spray container is mounted, operating means positioned at one end of the tubular member and coupled to said spray valve, and a spray outlet in said tubular member aligned with said nozzle means whereby upon depressing said operating means said spray valve may be actuated to release contents of said spray container through said outlet via said spray nozzle, the tubular member having a bottom opening covered by a bottom closure, the inner sidewalls of said tubular member being dimensioned to retain said spray container, whereby said spray container may be assembled within said tubular member via said bottom opening and held therein by said bottom closure; the improvement wherein said tubular member has an inwardly extending flange means at the end thereof opposite said bottom opening, said flange means defining an upper opening, said operating means comprises an upper closure for said tubular member having means depending therefrom slidably engaging said inner sidewalls of said tubular member, means engaging said flange means from the inner side of said tubular member to inhibit movement of said operating means through said upper opening, a groove extending longitudinally along said inner sidewalls of said tubular member from said bottom opening substantially to said flange means, said depending means comprising means slidably engaging said groove, whereby said operating means is limited substantially to only longitudinal sliding movement within said tubular member, the transverse dimensions of said tubular member at its inner sidewalls from said bottom opening substantially to said flange means being at least as great as the transverse dimensions of said depending means, whereby said operating means may be assembled in said tubular member via said bottom opening, said upper closure comprising a plate-shaped member positioned within said upper opening and of substantially the same shape as said upper opening, said depending means comprising a plurality of vanes extending longitudinally of said tubular member from said upper closure, said vanes having edges slidably engaging said inner sidewalls, and wherein said means engaging said flange means comprises stepped portions on said vanes.

5. The spray assembly of claim 4, wherein said plate-shaped member has an upper surface substantially flush with the outer surface of said tubular member at said flange means.

6. In a spray assembly of the type having a spray container, a spray valve and nozzle means for dispensing liquids from said spray container, an outer tubular body within which the spray container is mounted, operating means positioned at one end of the tubular member and coupled to said spray valve, and a spray outlet in said tubular member aligned with said nozzle means whereby upon depressing said operating means said spray valve may be actuated to release contents of said spray container through said outlet via said spray nozzle, the tubular member having a bottom opening covered by a bottom closure, the inner sidewalls of said tubular member being dimensioned to retain said spray container, whereby said spray container may be assembled within said tubular member via said bottom opening and held therein by said bottom closure; the improvement wherein said tubular member has an inwardly extending flange means at the end thereof opposite said bottom opening, said flange means defining an upper opening, said operating means comprises an upper closure for said tubular member having means depending therefrom slidably engaging said inner sidewalls of said tubular member, means engaging said flange means from the inner side of said tubular member to inhibit movement of said operating means through said upper opening, a groove extending longitudinally along said inner sidewalls of said tubular member from said bottom opening substantially to said flange means, said depending means comprising means slidably engaging said groove, whereby said operating means is limited substantially to only longitudinal sliding movement within said tubular member, the transverse dimensions of said tubular member at its inner sidewalls from said bottom opening substantially to said flange means being at least as great as the transverse dimensions of said depending means, whereby said operating means may be assembled in said tubular member via said bottom opening, said upper closure comprising a plate-shaped member extending transversely of said tubular member within said upper opening and being of substantially the same shape as said upper opening, and said depending means comprising a plurality of first vanes extending longitudinally of said tubular member from said upper closure and having edges slidably engaging said inner sidewalls, and vane means extending longitudinally of said tubular member from said upper closure and having a width greater than the width of said first vanes, said vane means having an edge slidably engaging said groove to inhibit rotation of said operating means with respect to said tubular member.

7. The spray assembly of claim 6, wherein said vane means comprises a pair of parallel spaced-apart second vanes each having an edge extending slidably into said groove, said groove being aligned with said spray outlet.

8. The spray assembly of claim 7, for use with a spray valve and nozzle means of the type including a nozzle tube extending laterally with respect to the spray container, wherein said nozzle tube extends laterally of said tubular member between said second vanes and is directed by said second vanes toward said spray outlet.

9. The spray assembly of claim 8 of the type wherein said spray valve comprises a depressable button, wherein said first and second vanes extend inwardly of said tubular member to laterally engage said button.

* * * * *